US006843453B1

(12) United States Patent
Rogers

(10) Patent No.: US 6,843,453 B1
(45) Date of Patent: Jan. 18, 2005

(54) BAG HOLDER ASSEMBLY

(76) Inventor: Patrick E. Rogers, 656 6$^{th}$ St., Lake Charles, LA (US) 70601

( * ) Notice: Subject to any disclaimer, the term of this patent is extended or adjusted under 35 U.S.C. 154(b) by 0 days.

(21) Appl. No.: 10/281,487

(22) Filed: Oct. 28, 2002

(51) Int. Cl.$^{7}$ ..... B65B 67/04
(52) U.S. Cl. ..... 248/99
(58) Field of Search ..... 404/495.08; 248/95, 248/97, 99, 100, 101

(56) References Cited

U.S. PATENT DOCUMENTS

| | | | | | |
|---|---|---|---|---|---|
| 85,511 | A | | 1/1869 | Crofoot | |
| 1,533,114 | A | * | 4/1925 | Herman et al. | 248/97 |
| 2,875,970 | A | | 3/1959 | Gardner | |
| 3,226,070 | A | | 12/1965 | Kurlander | |
| 4,322,048 | A | | 3/1982 | Vollman | |
| 5,180,126 | A | * | 1/1993 | Bennett | 248/99 |
| 5,263,672 | A | * | 11/1993 | He | 248/97 |
| 5,639,050 | A | | 6/1997 | Peterson et al. | |
| 5,797,567 | A | | 8/1998 | Magnafici | |
| 5,799,908 | A | | 9/1998 | Downs | |
| 6,003,820 | A | * | 12/1999 | Baldonado et al. | 248/99 |
| 6,325,341 | B1 | | 12/2001 | Brown | |
| 2002/0104932 | A1 | * | 8/2002 | Johnston | 248/97 |

OTHER PUBLICATIONS

Patent application Publication No. US 2001/0002690 A1 to Rosky; Publication Date Jun. 7, 2001.*
*Hardward Hotline Online*, Magic Ring Refuse Bag Holder, Oct. 2000, Cole Hardware, www.colehardware.com/hotline/2000/10/magicrng.htm.
Loopy Lawn & Leaf Bag Holder, Mar. 5, 2002, LOOPY Industrieswww.loopybagholder.com.

* cited by examiner

*Primary Examiner*—Ramon O Ramirez
(74) *Attorney, Agent, or Firm*—Kean, Miller, Hawthorne, D'Armond, McCowan & Jarma LLP

(57) ABSTRACT

A bag holder assembly is provided for suspending a storage bag and maintaining the orifice of the bag in the open position. The bag holder includes a base member, a plurality of bag support members, and a bag attachment means. The base member is preferably comprised of multiple beams joined together by a connecting means. The bag support members attach to and extend from the base member. Each bag support member comprises a bag attachment means for grasping and securing a portion of the bag to the bag support member. Once the opposing lips of the bag are secured against opposing bag support members, the orifice of the bag will remain open due to tension generated by the respective bag support members, thus allowing the use of two hands to place items in the bag or remove contents from the bag. Once loading or unloading has been accomplished, the user can rotate the bag support members approximately 270 degrees about the opposing ends of the base member until the opposing bag support members lie substantially flat against the underside of the base member. The invention further includes a method for loading and unloading a storage bag.

19 Claims, 5 Drawing Sheets

BAG HOLDER ASSEMBLY

CROSS-REFERENCE TO RELATED APPLICATION

Not applicable.

BACKGROUND OF THE INVENTION

1. Field of the Invention

This invention relates, generally, to devices designed to grasp and support bags of various sizes, and in particular, to devices for supporting plastic or paper bags in an upright position and for maintaining the orifice of a bag in an open position.

2. Description of Related Art

Bags and other collapsible containers for carrying items, whether for grocery or garbage or whether paper or plastic, present problems for those loading or unloading the contents of the bag. Namely, bags and other collapsible containers tend to fold upon themselves once tension has been removed from the bag orifice. In the past, consumers have traditionally overcome this problem by using one hand to hold the bag partially open while removing or inserting contents with the other hand.

A number of inventions have been developed to address the problems associated with bag loading and unloading. For example, U.S. Pat. Nos. 85,511, 2,875,970, 3,226,070, and 6,325,341 disclose bag support structures designed to hold the orifice of a bag in the open position. However, each of these devices has shortcomings, inasmuch as they are either not self contained (e.g., 6,325,341), not capable of being readily assembled, disassembled, transported, or stored (e.g., 2,875,970 and 4,322,048), or are awkward in their operation (e.g., 85,511 and 3,226,070).

Other bag support devices have similar shortcomings. U.S. Pat. No. 5,799,908 to Downs discloses a holder designed to accommodate plastic bags with carrying handles or straps. Although the Downs holder comprises support structures that extend upwardly from the base, the support structures are fixed in position and may not be folded or removed from the base structure, thus preventing the device from occupying unnecessary space when stored in a closet or cabinet.

U.S. Pat. No. 5,639,050 to Peterson et al. discloses a food storage bag holder constructed from first and second support members, which are vertically positioned in a parallel relationship. Because the support members are generally planar, the device only allows bags to be loaded or unloaded from directly above, thus preventing quick and easy access to the bag from all sides. Additionally, the primarily vertical construction of the Peterson device makes it prone to tipping if accidentally brushed against by the user.

U.S. Pat. No. 5,797,567 to Magnafici discloses a locking bag holder comprised of two stanchion assemblies connected by a crossbar. Although the Magnifici device may be adjusted to accommodate locking bags of different sizes, the device may not be conveniently stored without disassembling the crossbar from the stanchion assemblies.

As can be seen from the above discussion, the prior art has largely failed to satisfy the bag holding needs of the average household consumer. What is needed is an improved bag holder that overcomes the shortfalls of the devices that are currently known in the art. Specifically, what is needed is a bag support and holder that is easily assembled, operated, and transported, that is capable of quick and convenient storage, and that is able to accommodate virtually any type of bag.

OBJECTS OF THE INVENTION

It is an object of the present invention to provide a bag holder assembly that is easily assembled, operated, and transported, that is capable of quick and convenient storage, and that is able to accommodate many different types of bags.

Another object of the present invention is to provide a bag holder with a plurality of bag support structures designed to allow the user to access the suspended bag from all directions.

Another object of the present invention is to provide a bag holder with bag attachment means designed to secure any type of bag in the open position.

Another object of the present invention is to provide a bag holder with bag support structures that are capable of being folded or integrated with the base structure in order to minimize the amount of required storage space.

Another object of the present invention is to provide a bag holder that is made from inexpensive materials and is comparatively inexpensive to manufacture and maintain.

SUMMARY OF THE INVENTION

A bag holder assembly is provided for suspending a storage bag, such as a paper or plastic food storage bag, and maintaining the orifice of the bag in the open position. The bag holder includes a base member, a plurality of bag support members, and a bag attachment means. The base member is preferably comprised of multiple beams joined together by a connecting means. The bag support members attach to and extend from the base member. Each bag support member comprises a bag attachment means for grasping and securing a portion of the bag to the bag support member.

In a preferred embodiment, the individual beams comprising the base member form a rectangular or square shape. Two bag support members, each of which is preferably constructed from two support arms joined together to form a triangular arch, extend from opposing ends of the base member and in a direction that is substantially perpendicular to the base member. In one embodiment, a cross brace can be used to lend additional support to the bag support members. Bag attachment means are secured near the intersection of the two support arms and are adapted to grasp and secure the lip of a bag against the bag support member.

Once the opposing lips of the bag are secured against opposing bag support members, the orifice of the bag will remain open due to tension generated by the respective bag support members, thus allowing the use of two hands to place items in the bag or remove contents from the bag. Once loading or unloading has been accomplished, the user can rotate the bag support members approximately 270 degrees about the opposing ends of the base member until the opposing bag support members lie substantially flat against the underside of the base member. This feature allows for convenient storage of the bag holder by minimizing the amount of space occupied by the bag holder.

An alternative embodiment of the invention includes the use of telescoping beams on the base member to accommodate bags of different widths.

Another embodiment of the invention includes the use of telescoping arms and lateral hinges on the bag support members to accommodate bags of different heights.

Another embodiment of the invention includes alternative configurations of bag support members.

Another embodiment of the invention includes alternative configurations of the base member.

Another embodiment of the invention includes the use of a flexible base member, which allows the bag holder to be easily assembled and disassembled.

Another embodiment of the invention requires the affixation of the base member to a vertical surface and reorienting the attachment means to receive and secure a bag in the upright position and to maintain the orifice of the bag in the open position.

Another embodiment of the invention requires the bag holder to be inverted and the base member secured to the underside of a horizontal structure, such as a cabinet, with the bag attachment means realigned to secure the bag in the upright position and to maintain the orifice of the bag in the open position.

These and other objects, advantages, and features of this invention will be apparent from the following description.

DETAILED DESCRIPTION OF THE INVENTION

Figure 1:
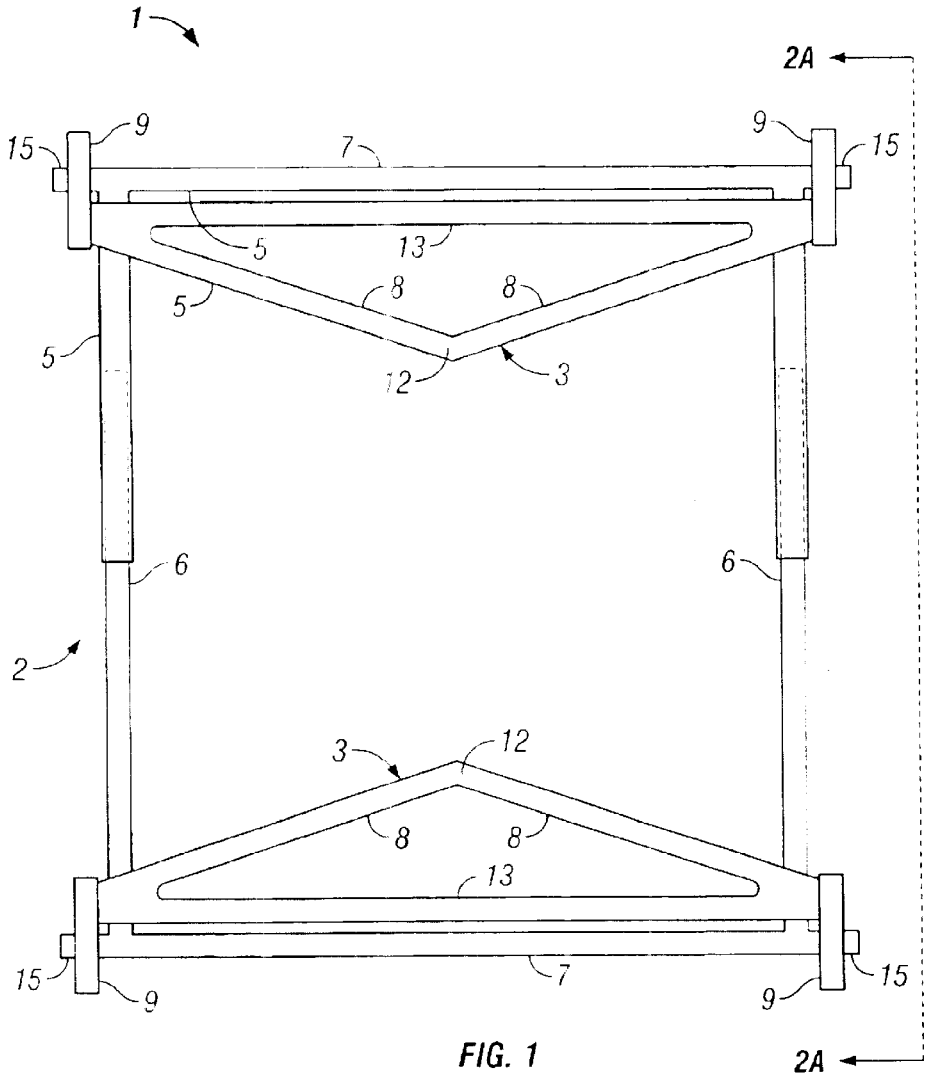
FIG. 1 is a plan view of the preferred embodiment of base member with bag support members.

With reference to FIGS. 1–4, a preferred embodiment of bag holder 1 will now be described. As shown in FIGS. 1–4, bag holder 1 comprises a base member 2, bag support members 3, and bag attachment means 4. Base member 2 may be of any shape or thickness, so long as the resulting structure provides a stable base for supporting the bag holder. Base member 2 may be fashioned from any material, including, but not limited to plastic, metal, or wood. As shown in FIG. 1, base member 2 is preferably constructed using a plurality of beams 5, which may have various cross sections, including cross sections that are square, rectangular, cylindrical, triangular, or any other cross section known to those of ordinary skill in the art. Beams 5 may be molded, glued, or snapped together, depending on the material selected. Other means known to those skilled in the art, including, but not limited to the use of dovetailing or the insertion of modified beam ends into recesses in the receiving beam (as shown in FIG. 3A), may also be used.

The preferred base member 2 depicted in FIG. 1 includes four beams 5, which include two longitudinal beams 6 and two transverse beams 7. Longitudinal beams 6 are spaced apart in a parallel arrangement and connect to the inside edges of transverse beams 7. Transverse beams 7 overlap longitudinal beams 6 at their distal ends as shown in FIG. 1 by a margin sufficient to create projections 15 for the attachment of bag support members 3. For purposes of clarity, FIG. 1 depicts each of projections 15 as being approximately 10% of the total length of transverse beams 7. However, the actual length of each of projections 15 may be as small or large as necessary to allow bag support members 3 to be secured to transverse beams 7.

Figure 5:
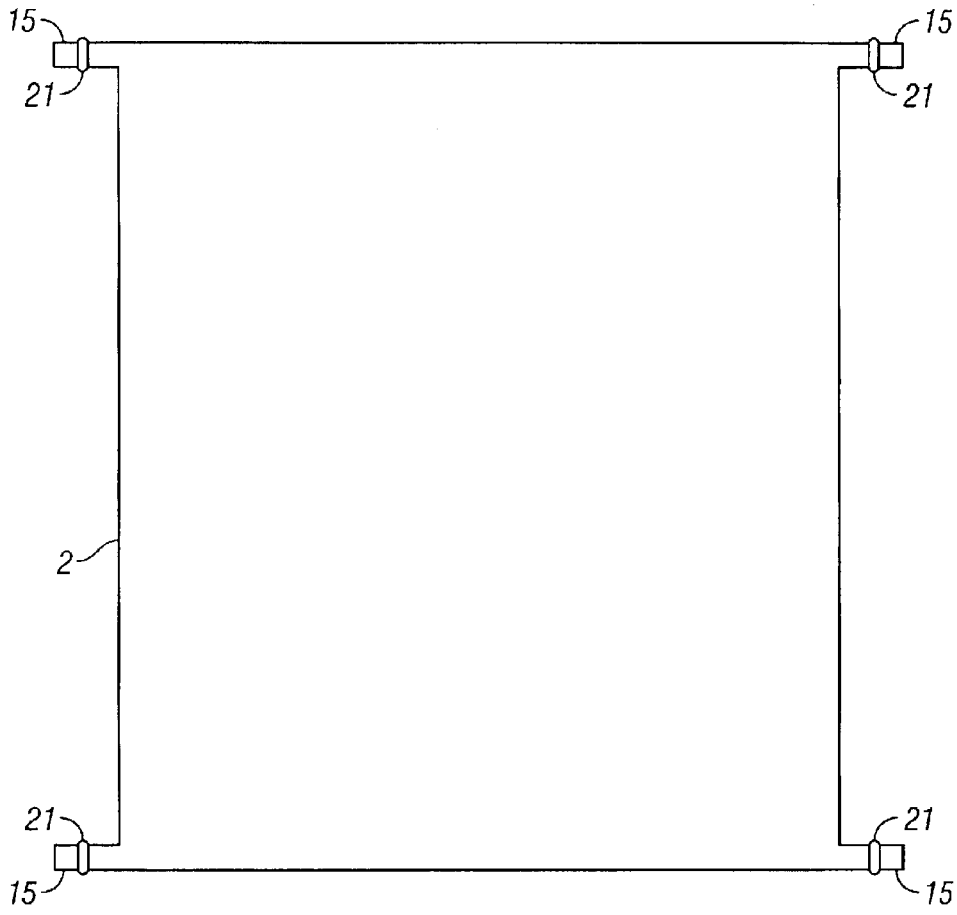
FIG. 5 is a plan view of an alternative embodiment of the base member.

Although projections 15 may simply be an extension of transverse beams 7, projections 15 may also include locking means 21, which are shown in FIG. 5 as raised bosses on projections 15. Alternatively, locking means 21 may comprise an aperture (not shown) drilled through projection 15 and a pin (also not shown) inserted through the aperture on the outside of bag support members 3. Other locking means 21 known to those skilled in the art are also contemplated by the present invention.

In the alternative embodiment shown in FIG. 5, base member 2 may comprise a single planar sheet or multiple planar sheets of material with projections 15 at each corner adapted to receive bag support members 3. This type of construction will provide greater weight and stability to base member 2, as compared to the preferred embodiment depicted in FIG. 1. In a further alternative embodiment, base member 2 may comprise beams 5 in addition to longitudinal beams 6 and transverse beams 7 depicted in FIG. 1. Additional beams 5 would lend further structural support to base member 2.

Bag support members 3 comprise support arms 8, feet 9, and arresting means 10. Although bag holder 1 may include as many bag support members 3 as there are attachments provided on base member 2, two bag support members 3 should preferably be used in conjunction with base member 2, as shown in FIGS. 1–4. Restricting bag holder 1 to two bag support members 3 will increase the range of access to suspended bag 11, as shown in FIGS. 2 and 4.

Bag support members 3 may have a number of shapes as desired. In the preferred embodiment, two support arms 8 extend from projections 15 on opposing ends of a single transverse beam 7 and connect in the center to form pinnacle 12. Pinnacle 12 may be modified as shown in FIG. 3A to provide mount 20 to allow bag attachment means 4 to be rigidly secured on the inner surface of pinnacle 12.

In order to provide additional structural support to bag support members 3, cross brace 13 may be inserted between the lower portions of support arms 8 near feet 9 and secured in place by inserting the respective ends of cross brace 13 into apertures drilled into support arms 8. Alternatively, cross brace 13 may be secured in place by molding or other means known to those skilled in the art. Additionally, triangular braces 14 may be added to secure cross brace 13 in place. Triangular braces 14 may be integrated with support arms 8 and cross brace 13, or they may be affixed using other means commonly known in the art.

Arresting means 10, which provide a means for arresting the rotation of bag support members 3 about projections 15, are preferably located near the intersection of support arms 8 with longitudinal beams 6. In the preferred embodiment in FIGS. 1–2B and 3B, arresting means 10 are depicted as spurs projecting from the lower portions of support arms 8 and contacting the upper surface of longitudinal beams 6. Alternatively, a single spur may be attached to one support arm 8 on each of bag support members 3. Although arresting means 10 are depicted as triangular in shape and located at the intersection of support arms 8 with longitudinal beam 6, arresting means 10 can take on virtually any shape and be located along any portion of bag support member 3, so long as the selected arresting means 10 functions to restrain the rotation of bag support members 3 in the upright and operable position. Additionally, although arresting means 10 are depicted as being molded to and thus an integral part of support arms 8, arresting means 10 may be secured to bag support member 3 or base member 2 by any other means known to those of ordinary skill in the art, including, but not limited to adhesives, snapping means, or mechanical screws.

Feet 9, which lend additional support to bag support members 3 by contacting the surface upon which bag holder 1 is placed, are shown in FIGS. 1–3B as molded extensions of support arms 8 located at the intersections of support arms 8 with projections 15. If so desired, however, feet 9 may comprise an independent attachment to support arms 8 and may be connected to support arms using screws, snaps, or other means known to those in the art. Additionally, feet 9 may assume shapes in addition to the square or rectangular shapes shown in FIGS. 1–3B. Feet 9 may also be smaller and thus less pronounced than those shown in the preferred embodiment or may even be omitted from bag support members 3 altogether.

Regardless of the shape or size of feet 9, feet 9 preferably contain hinge apertures 16 for receiving projections 15, which pass through hinge apertures 16. Additionally, feet 9 may optionally be equipped with nubbins 17 (or any other high friction material) on the underside of feet 9 to increase the amount of friction between bag holder 1 and the selected surface to prevent sliding of the entire assembly. Preferably, nubbins 17 are fashioned from a plastic or rubber material and are secured to feet 9 using an adhesive or similar means.

Figure 2A:
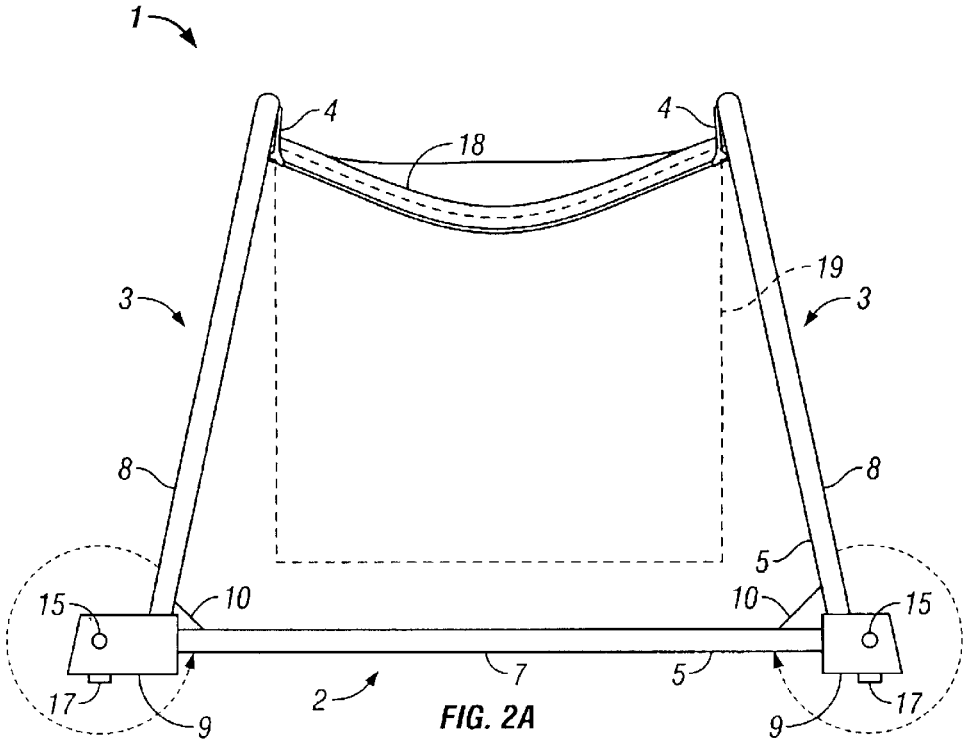
FIG. 2A is a side view of the preferred embodiment of the bag holder with bag support members in the upright position.
Figure 2B:
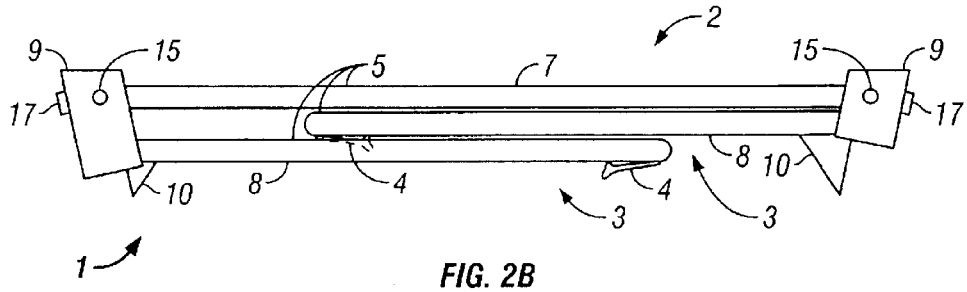
FIG. 2B is a side view of the preferred embodiment of the bag holder with bag support members in the retracted position.
Figure 3A:
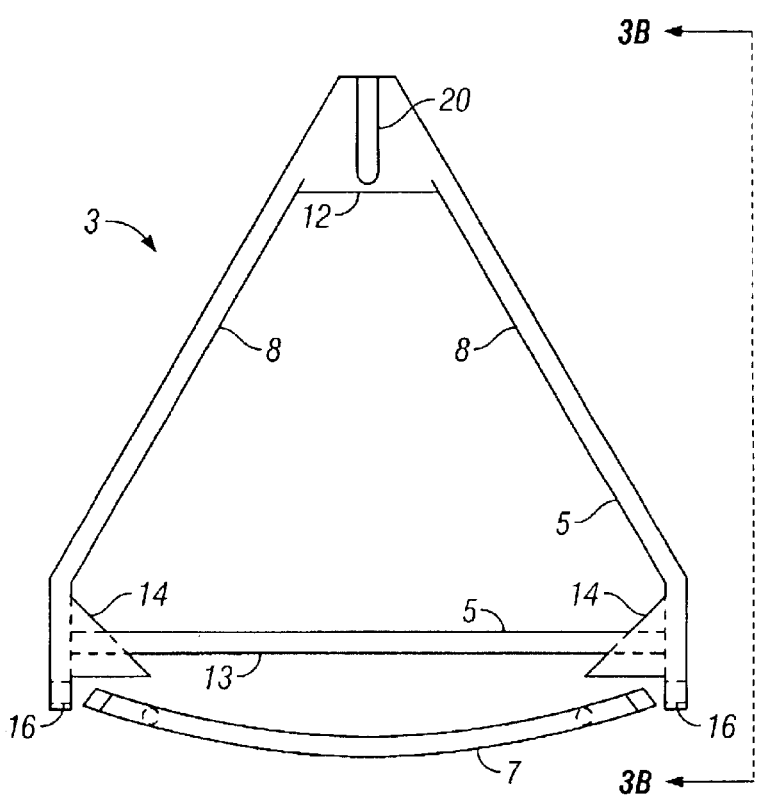
FIG. 3A is a side view of an embodiment of the bag support member as viewed along line 3A shown in FIG. 2A.
Figure 3B:
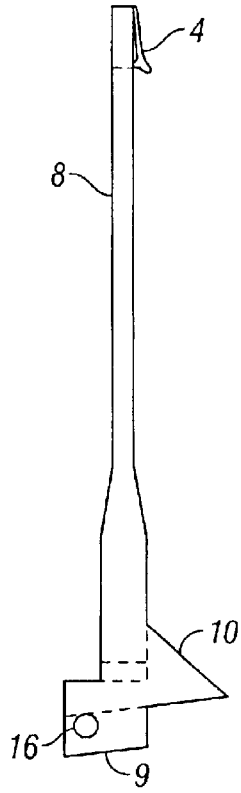
FIG. 3B is a side view of the embodiment of the bag support member shown in FIG. 3A, as viewed along line 3B.
Figure 4:
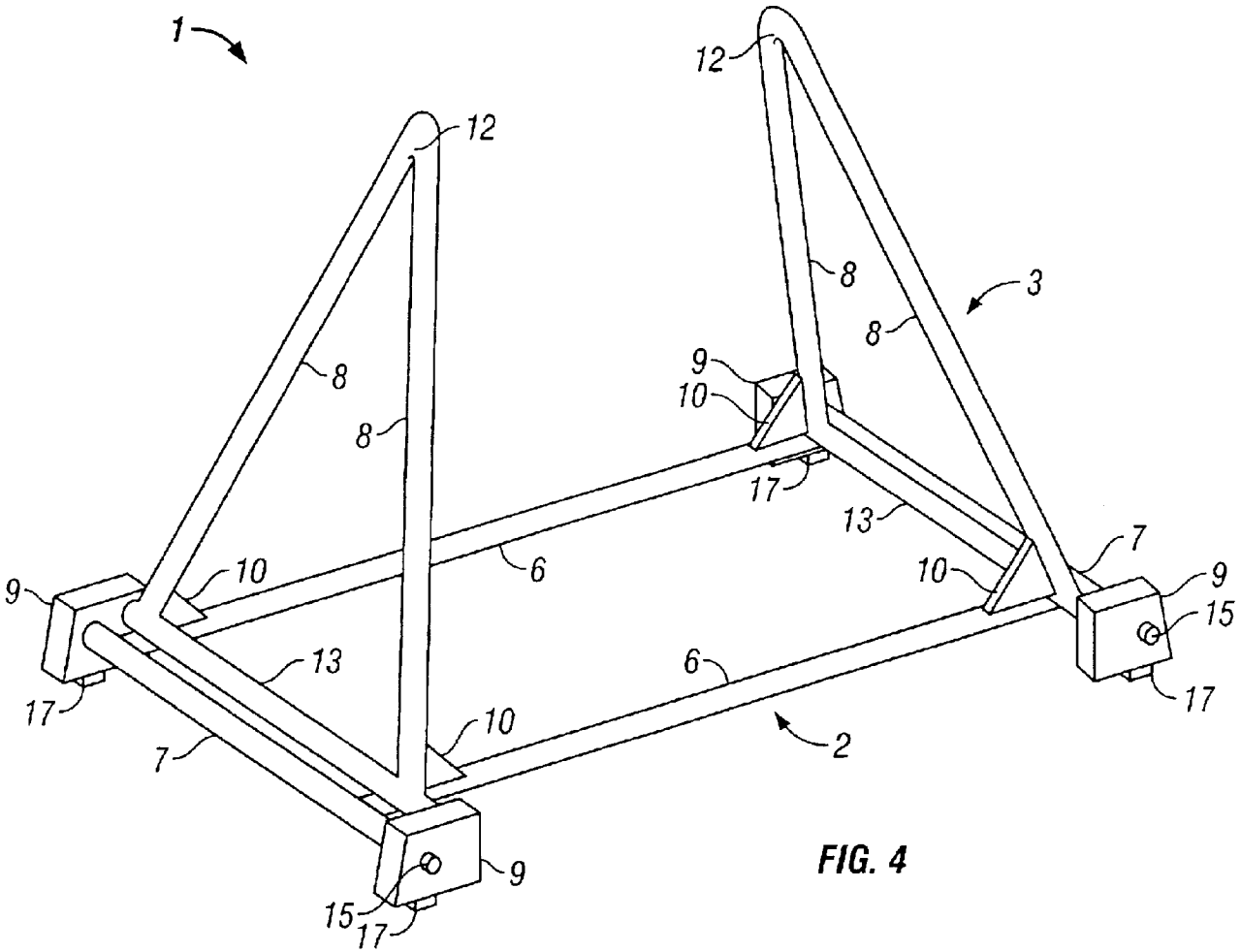
FIG. 4 is a perspective view of the bag support member detail of one embodiment of the bag holder.

In the preferred embodiment, attachment means 4 comprise molded clips for maintaining storage bag 19 in the open position as shown in FIGS. 2A, 2B, and 3B. However, attachment means 4 may also include other means known to those skilled in the art for grasping and securing storage bag 19, including, but not limited to, spring clips, binder clips, adhesives, and clothespins. Referring to FIG. 2A, attachment means 4 are adapted to hold lip 18 of storage bag 19 against pinnacle 12 and support arms 8. In particular, attachment means 4 are particularly suited to grasp and hold sealable locking or "zipper" bags (as depicted in FIG. 2A).

From the foregoing description and drawings, the operation of the preferred embodiment of bag holder 1 can be readily understood. Bag support members 3 are first attached to base member 2 via projections 15 and are rotatably secured thereon. The manner of attaching bag support members 3 to base member 2 depends on the material(s) from which support members 3 and base member 2 are constructed. In one embodiment, both are fashioned from a flexible plastic material, which allows the user to flex a slight arc in base member 2 as shown in FIG. 3A. By bending base member 2, the distance between projections 15 is temporarily reduced, thereby allowing projections 15 to slide into hinge apertures 16.

Once bag support members 3 are rotatably secured on projections 15, the entire assembly is then placed on a flat surface, such as a kitchen countertop, or secured to a flat wall or under a hanging cabinet using screws, adhesives, or similar means. Bag support members are then rotated towards each other until arresting means 10 contact longitudinal beams 6 and resist further forward movement of bag support members 3. Once arresting means 10 contact longitudinal beams 6, bag support members 3 are in the operable position as shown in FIG. 2A. As depicted in FIGS. 2A and 4, when in the operable position, bag support members 3 may be slightly angled towards each other a few degrees from vertical, which arrangement helps to maintain storage bag 19 in the open position.

When bag support members 3 are in the operable position, lip 18 of storage bag 19 is secured to attachment means 4. In the embodiment shown in FIGS. 2A and 3B, the user slides lip 18 under attachment means 4, where it is frictionally secured against pinnacle 12. Alternatively, storage bag 19 may be secured directly to bag support members 3. This latter embodiment may be useful when storage bag 19 contains handles, in which case the handles could be draped or looped over bag support members 3 rather than being attached to attachment means 4.

Once the user has finished loading or unloading storage bag 19, storage bag 19 is removed from bag support members 3 by sliding lips 18 out of attachment means 4 or by simply removing the handles (if any) from bag support members 3. If the user does not wish to load or unload additional bags, the entire bag holder 1 may be collapsed and placed in storage. In order to collapse bag holder 1, bag support members 3 may be disconnected from base member 2 by again flexing an arc in base member 2 and removing projections 15 from hinge apertures 16.

Alternatively, the user may fold bag holder 1 into the storage position as shown in FIG. 2B for substantially flat storage of the entire assembly. The storage position is achieved by simply rotating bag support members 3 away from each other and through an angle of approximately two hundred and seventy (270) degrees from the operable position (see arrows in FIG. 2A). As can be seen in FIGS. 2A and 2B, one of bag support is members 3 is slightly offset from one of feet 9. The non-offset bag support member 3 is first rotated about projection 15 until the side opposite from attachment means 4 lies flush against the underside of base member 2. Next, the offset bag support member 3 is rotated about projection 15 until the side opposite attachment means 4 contacts the inner surface of the opposing bag support member 3. The offset thus allows bag support members 3 to fit together in a parallel relationship once folded into the storage position. It will be readily appreciated from the drawings that once bag support members 3 have been rotated into the storage position, arresting means 10 will serve as the only point of contact of bag holder 1 with the support surface, thereby preventing attachment means 4 from becoming damaged or dirty through contact with the support surface.

Bag holder 1 may also be secured to different surfaces to suit the needs of the user. In one embodiment, bag support members may be rotated into the operable position, the entire assembly inverted, and base member 2 secured to the underside of a flat surface (e.g., a hanging cabinet) using adhesives, screws, or the like. In this manner, the user may either leave attachment means 4 in the original position or reorient attachment means 4 to receive storage bag 19 from below. Similarly, bag holder 1 may be secured to a flat vertical surface, such as a kitchen wall, and attachment means 4 reoriented to suit the needs of the user.

If so desired, bag holder 1 may also be modified to accommodate different sizes of storage bags 19 by slightly modifying base member 2 and bag support members 3. In order to accommodate storage bags 19 of different widths, longitudinal beams 6 may be telescoping beams (not shown), thus allowing the user to increase or decrease the distance between bag support members 3 when in the operable position. In order to accommodate storage bags 19 of different heights, support arms 8 may also be telescoping and pinnacles 12 fitted with one or more hinges (not shown) to adapt to the change in the angles at which support arms intersect. Additionally, hinges should also be added to support arms 8 below the telescoping members in order to accommodate for the change in the angles at which support arms intersect.

There are, of course, other alternate embodiments that are obvious from the foregoing descriptions of the invention, which are intended to be included within the scope of the invention, as defined by the following claims.

I claim:

1. A bag folder for supporting a storage bag, said bag holder comprising:

(a) a base member;

a plurality of projections, said plurality of projections attached to said base member; and a plurality of bag support members, said bag support members attached to said projections and rotatable about said projections, wherein said bag support members are rotated approximately two hundred seventy (270) degrees about said base member and folded beneath said base member for substantially flat storage.

2. A bag holder for supporting a storage bag, said bag holder comprising:

(a) a base member;

(b) a plurality of projections said plurality of projections attached to said base member;

(c) a plurality of bag support members, said bag support members attached to said projections and rotatable about said projections through an angle of at least forty-five degrees, wherein each of said bag support members rotates independently of the other bag support members;

(d) an attachment means, said attachment means secured to at least one of said plurality of bag support members and adapted to hold said storage bag in an open position, wherein said attachment means is selected from the group consisting of molded clips, spring clips, binder clips, adhesives, and clothespins.

3. A bag holder for supporting a storage bag, said bag holder comprising:

(a) a base member;

(b) a plurality of projections, said plurality of projections attached to said base member; and (c) a plurality of bag support members, said bag support members attached to said projections and rotatable about said projections, wherein said bag support members further comprise a plurality of hinge apertures for receiving said projections, and each of said bag support members rotates independently of the other bag support members.

4. The bag holder described in claim 3, wherein said base member is flexible to allow for the insertion of said projections into said hinge apertures.

5. The bag holder described in claim 3, wherein each of said bag support members further comprise a foot, said foot adapted to provide stable contact with a support surface and containing one of said hinge apertures.

6. A bag holder for supporting a storage bag, said bag holder comprising:

(a) a base member, said base member further comprising:

(i) at least one longitudinal beam; and (ii) a plurality of transverse beams, each of said transverse beams connected to said at least one longitudinal beam;

(a) a plurality of projections said plurality of projections attached to said base member; and (b) a plurality of bag support members, said bag support members attached to said projections and rotatable about said projections through an angle of at least fort-five degrees, wherein each of said bag support members rotates independently of the other bag support members.

7. The bag holder described in claim 6, wherein said at least one longitudinal beam further comprises a telescoping means, wherein said telescoping means is adapted to extend or reduce the length of said longitudinal beam in order to accommodate different sizes of said storage bags.

8. The bag holder described in claim 6, wherein said at least one longitudinal beam and said plurality of transverse beams fit together in a snapping relationship.

9. A bag holder for supporting a storage bag, said bag holder comprising:

(a) a base member;

(b) a plurality of projections, said plurality of projections attached to said base member; and (c) a plurality of bag support members, said bag support members attached to said projections and rotatable about said projections through an angle of at least forty-five degrees, wherein each of said bag support members rotates independently of the other bag support members, said bag support members further comprising (i) at least one support arm; and (ii) an arresting means, said arresting means adapted to resist the movement of said bag support members about said projections.

10. The bag holder described in claim 9, said bag holder further comprising a plurality of attachment means, each of said attachment means secured to one of said plurality of bag support members and adapted to hold said storage bag in an open position.

11. The bag holder described in claim 10, wherein said attachment means is selected from the group consisting of molded clips, spring clips, binder clips, adhesives, and clothespins.

12. The bag holder described in claim 9, wherein each of said bag support members further comprise at least two support arms with a cross bar connected to said at least two support arms, wherein said cross bar provides additional support to each of said bag support members.

13. The bag holder described in claim 9, wherein said arresting means is at least one spur attached to said at least one support arm.

14. The bag holder described in claim 9, wherein said bag support members are rotated approximately two hundred seventy (270) degrees about said base member and folded beneath said base member for substantially flat storage.

15. The bag holder described in claim 14, wherein said at least one support arm on one of said plurality of bag support members is offset from said at least one support aim on an opposing bag support member to allow said plurality of bag support members to be folded underneath said base member such that said support arms are parallel to said base member.

16. The bag holder described in claim 14, said bag holder further comprising a plurality of attachment means, each of said attachment means secured to one of said plurality of bag support members and adapted to hold said storage bag in an open position, wherein said arresting means, after being folded underneath said base member, prevent said attachment means from contacting a surface onto which said bag holder is placed.

17. A method for loading or unloading a storage bag said method comprising the steps of:

(a) providing a base member;

(b) attaching a plurality of projections to said base member;

(c) attaching a plurality of bag support members to said projections, such that said bag support members are rotatable about said projections through an angle of at least forty-five degrees;

(d) securing an attachment means to at least one of said plurality of bag support members;

(e) attaching said storage bag to said attachment means, such that the orifice of said storage bag is held in an open position.

18. The method described in claim 17, said method further comprising the step of attaching said base member to a rigid structure, said surface selected from the group consisting of a horizontal surface, an overhanging surface, or a vertical surface.

19. The method described in claim 18, said method further comprising the step of orienting said attachment means to maintain said orifice of said storage bag in an upright position when said rigid structure is an overhanging surface or a vertical surface.

* * * * *